US006443175B1

(12) United States Patent
Pabst

(10) Patent No.: US 6,443,175 B1
(45) Date of Patent: Sep. 3, 2002

(54) VACUUM PRESSURE GENERATOR CIRCUIT WITH NON-VOLITILE MEMORY FUNCTION

(75) Inventor: William V. Pabst, Murfreesboro, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/616,425

(22) Filed: Jul. 14, 2000

Related U.S. Application Data

(60) Provisional application No. 60/185,438, filed on Feb. 28, 2000.

(51) Int. Cl.[7] ..... F16K 31/12; B25J 15/06; F04F 5/48

(52) U.S. Cl. ..... 137/12; 137/14; 137/487.5; 137/565.14; 137/565.22; 137/596.15; 251/26

(58) Field of Search ..... 137/12, 14, 487.5, 137/565.12, 565.13, 565.14, 565.22, 596.15; 251/26; 294/64.2

(56) References Cited

U.S. PATENT DOCUMENTS 4,750,768 A * 6/1988 Kumar ..... 294/64.1
5,201,560 A * 4/1993 Golden ..... 137/487.5
5,277,468 A * 1/1994 Blatt et al. ..... 294/64.2

* cited by examiner

*Primary Examiner*—Michael Powell Buiz
*Assistant Examiner*—Ramesh Krishnamurthy

(57) ABSTRACT

The present invention is a pressure feedback circuit for use with a vacuum pressure control circuit. The pressure feedback circuit detects the occurrence of, and controls the generation of vacuum pressure under, External Override Conditions ("EOCs"). During EOCs, which typically include emergency stop conditions or loss of electrical power to the vacuum pressure circuit, the pressure feedback circuit senses the condition of the output vacuum pressure port and supplies feedback to the vacuum pressure control circuit thereby maintaining the last output state of the vacuum pressure control circuit.

14 Claims, 2 Drawing Sheets

VACUUM PRESSURE GENERATOR CIRCUIT WITH NON-VOLITILE MEMORY FUNCTION

This application claims benefit of earlier filed U.S. Provisional Application No. 60/184538 filed Feb. 28, 2000.

FIELD OF THE INVENTION

The present invention relates to the field of vacuum generators that use Venturi valves. More particularly, the present invention relates to the field of controlled vacuum generators that include feedback for maintaining the operating mode or function of the vacuum generator in the event of an emergency stop condition or if electrical power is lost.

OBJECTS OF THE INVENTION

It is an object of the present invention to provide a pressure feedback circuit for controlling the output of vacuum pressure generator.

It is an object of the present invention to provide a pressure feedback circuit for controlling a vacuum pressure generator in the event of emergency conditions that preclude the use of electrical power to control the vacuum pressure generator.

It is an object of the present invention to provide a pressure feedback circuit to maintain the same state of output pressure for a vacuum pressure generator in the event of an emergency condition or loss of electrical power.

SUMMARY OF THE INVENTION

The present invention is a pressure feedback circuit for use with a vacuum pressure control circuit. The vacuum pressure control circuit comprises a pressure controlled valve to control the application of an independent pressure source to a vacuum pressure generator thereby generating vacuum pressure at an output vacuum pressure port. The vacuum pressure control circuit controls the generation of vacuum pressure under normal operating conditions.

The pressure feedback circuit detects the occurrence of, and controls the generation of vacuum pressure under, External Override Conditions ("EOCs"). During EOCs, which typically include emergency stop conditions or loss of electrical power to the vacuum pressure circuit, the pressure feedback circuit senses the condition of the output vacuum pressure port and supplies pressure feedback to the vacuum pressure control circuit thereby maintaining the last output state of the vacuum pressure control circuit.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

The present invention, a Vacuum Pressure Generator Circuit with Non-Volitile Memory Function, comprises a vacuum pressure control circuit combined with a pressure feedback circuit. The vacuum pressure control circuit uses an independent air pressure source 4 to create vacuum, or negative, pressure at an output vacuum pressure port 6. The pressure feedback circuit detects External Override Conditions ("EOC") and, in the event of such conditions, enables pressure feedback, which sustains the last output state of the vacuum pressure control circuit, and accordingly the vacuum pressure port 6, until the EOC ceases. Typical EOCs include the occurrence of an operator commanded emergency stop condition, or a loss of electrical power to the vacuum pressure control circuit.

Figure 1:
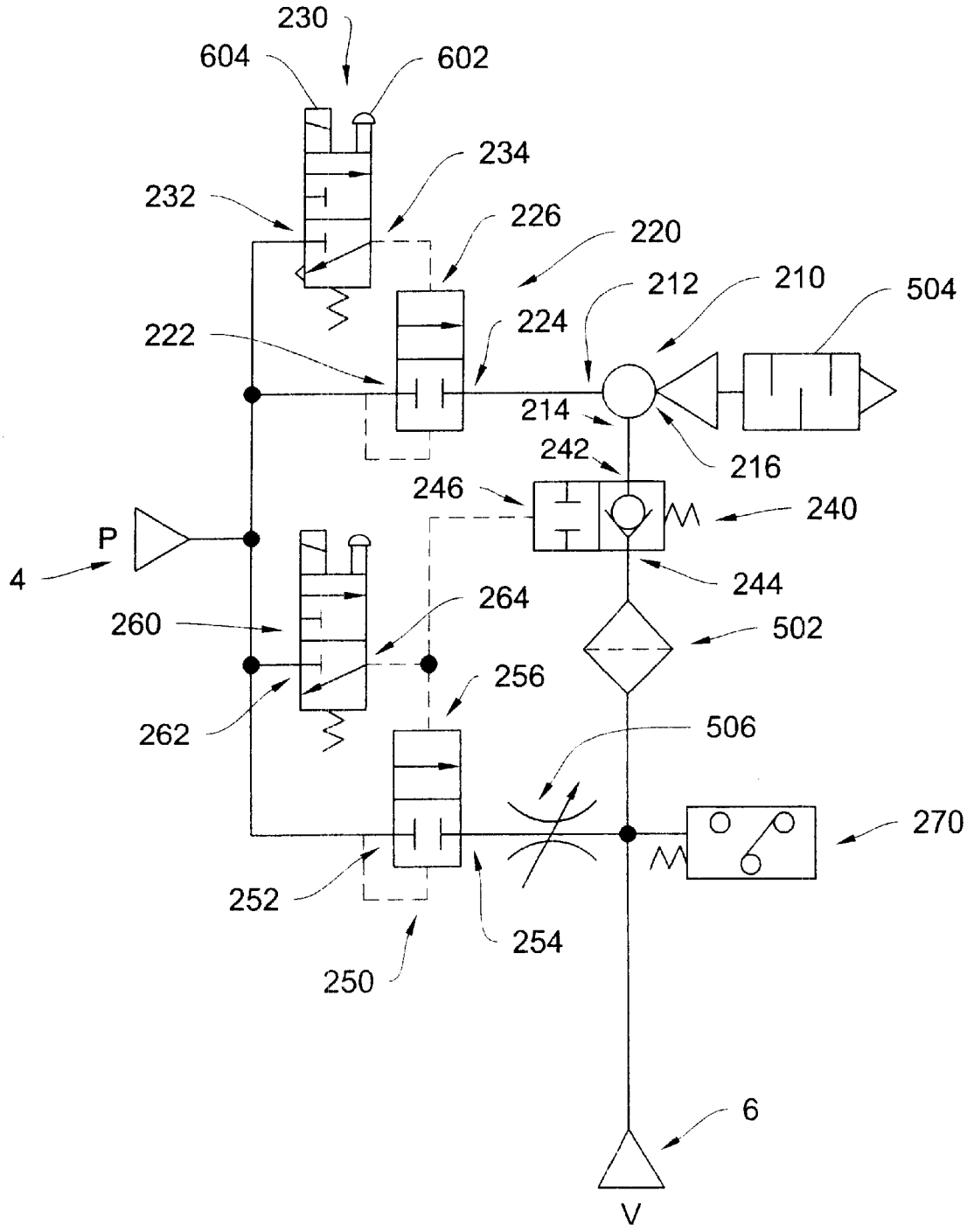
FIG. 1 depicts a vacuum generation and control circuit.

The vacuum pressure control circuit used with the present invention includes a vacuum pressure generator 210 that is controllable by pressure valves, to direct air pressure to and away from the vacuum pressure generator 210. Vacuum pressure generators 210 used with the present invention are common in the art and use pressure as an input to create vacuum, or negative, pressure at a vacuum pressure port 214. FIG. 1 depicts a vacuum pressure control circuit using industry standard representations of pressure valve components.

Referring to FIG. 1, the vacuum pressure control circuit includes a master pressure valve 220 having a master pressure inlet 222 coupled to a master pressure exhaust 224. The master pressure valve 220 is controllable by a master pressure sensor 226 that enables two states of the master pressure valve 220. The first state retards pressure flow, or exchange, between the master pressure inlet 222 and the master pressure exhaust 224 and, the second state enables pressure flow or exchange between the master pressure inlet 222 and the master pressure exhaust 224. Pressure controllable valves such as the master pressure valve 220 described above are common in the art and presumed to be within the knowledge of an ordinarily skilled practitioner in the art. The symbol depicted by reference numeral 220 is a common industry standard depiction of a valve such as that described above. The master pressure inlet 222 is coupled to the independent pressure source 4.

Combination controllable pressure valves are also common in the art and this type of valve is used in the present invention to implement a master control valve 230. The master control valve 230 controls the master pressure valve 220 under normal operating conditions. The master control valve 230 further comprises a master control inlet 232 that is coupled to a master control exhaust 234. The master control inlet 232 is coupled to the independent pressure source 4 and the master control exhaust 234 is coupled to the master pressure sensor 226 of the master pressure valve 220. The master control valve 230 enables the selection of two valve states. The first state retards pressure flow, or exchange, between the master control inlet 232 and the master control exhaust 234 and, the second state enables pressure flow or exchange between the master control inlet 232 and the master control exhaust 234. The master control valve 230 states are selectable either by a transducer comprising either an electronic solenoid 602 or a mechanical plunger 604.

Under normal operating conditions, the generation of vacuum pressure is commanded by the master control valve 230 by an operation of either the electronic solenoid 602 or the mechanical plunger 604. The operation ports pressure from the independent pressure source 4 through to the master pressure sensor 226 of the master pressure valve 220. As a result, the master pressure valve 220 ports pressure from the independent pressure source 4 through to the vacuum pressure generator 210 thereby generating vacuum pressure at the vacuum pressure port 214.

Additionally, the vacuum pressure circuit in FIG. 1 also depicts a master blow-by valve 260, a blow-by pressure valve 250, and a vacuum cut-off valve 240. In the air pressure circuit depicted in FIG. 1, the master blow-by valve is also implemented with a combination controllable pressure valve that is controllable by a transducer. The blow-by pressure valve 250 functions similarly to the master pressure valve 220 and includes a third pressure sensor to control the direction of the independent pressure source 4 through to the output vacuum pressure port 6 during a blow-by pressure command from the master blow-by valve 260.

Under normal operating conditions the master blow-by valve 260 controls the pressure blow-by valve 250 and the vacuum cut-off valve 240 in the event that the operator commands the vacuum pressure circuit to cease generating vacuum pressure at the output vacuum pressure port 6. The master blow-by valve 260 includes a master blow-by inlet 262 coupled to a master blow-by exhaust 264 and enables the selection of two valve states. The first state retards pressure flow, or exchange, between the master blow-by inlet 262 and the master blow-by exhaust 264 and, the second state enables pressure flow or exchange between the master blow-by inlet 262 and the master blow-by exhaust 264.

The blow-by pressure valve 250 is implemented with a pressure controllable valve and includes a blow-by pressure inlet 252 coupled to a blow-by pressure exhaust 254. The blow-by pressure valve 250 enables positive pressure output at the output vacuum pressure port 6 thereby releasing any object held by the vacuum pressure generated by the vacuum pressure circuit. The blow-by pressure valve 250 is enabled with a pressure valve that enables the selection of two valve states. The first state retards any pressure flow, or exchange, between the blow-by pressure inlet 252 and the blow-by pressure exhaust 254 and, the second state enables pressure flow or exchange between the blow-by pressure inlet 252 and the blow-by pressure exhaust 254.

The vacuum cut-off valve 240 is also implemented with a pressure controllable valve and includes a vacuum cut-off pressure sensor 246, a vacuum cut-off inlet 242 and a vacuum cut-off exhaust 244. The vacuum cut-off valve 240 retards the application of vacuum pressure at the output vacuum pressure port 6 when the master blow-by valve 260 directs pressure to the vacuum cut-off pressure sensor 246. The vacuum cut-off valve 240 is implemented with a pressure valve that enables the selection of two valve states. The first state retards any pressure flow, or exchange, between the vacuum cut-off inlet 242 and the vacuum cut-off exhaust 244 and, the second state enables pressure flow or exchange between the vacuum cut-off inlet 242 and the vacuum cut-off exhaust 244.

In the event of a command to stop generating vacuum pressure delivered by a transducer (e.g. mechanical plunger or electronic solenoid) associated with the master blow-by valve 260, the master blow-by valve 260 directs the independent pressure source 4 to apply pressure to the blow-by valve pressure sensor 256. The blow-by valve pressure sensor 256 in turn enables the blow-by pressure valve 250 to apply positive pressure to the output vacuum pressure port 6 and, as a result, release any object held by the vacuum pressure port 6. Concurrently, the master blow by valve 260 also directs the independent pressure source 4 to the vacuum cut-off pressure sensor 246 thereby commanding the vacuum cut-off valve 240 to block the vacuum pressure generated by the vacuum pressure generator 210.

The vacuum pressure circuit further includes an electronic vacuum sensor 270. The electronic vacuum sensor 270 senses the vacuum output pressure generated at the output vacuum pressure port 6, and under normal operating conditions, controls the magnitude of vacuum pressure generated by the vacuum pressure generator 210 depending on the vacuum output pressure sensed by the electronic vacuum sensor 270. A filter 502 prevents debris from entering the vacuum pressure port 214 and a silencer 504 reduces the noise generated by the vacuum pressure generator 210. A pressure regulator 506 controls the magnitude of positive pressure applied to the output vacuum pressure port 6 during a blow-by command from the master blow-by valve 260.

Figure 2:
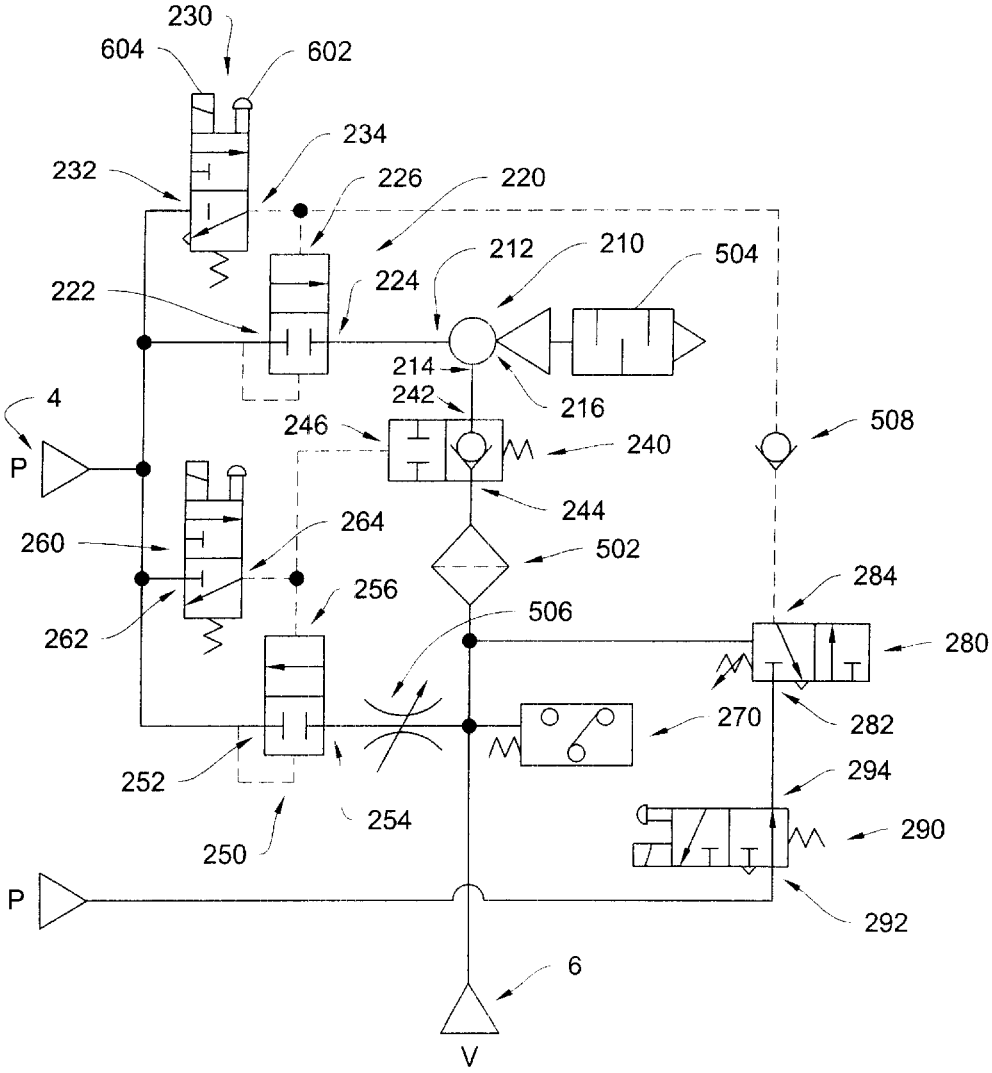
FIG. 2 depicts an implementation of aspects of the present invention together with the vacuum generation and control circuit.

The pressure feedback circuit is depicted in FIG. 2 in combination with the vacuum pressure control circuit of FIG. 1. The preferred pressure feedback circuit_comprises a pressure feedback valve 280, a pressure feedback-control valve 290, and a check valve 508. The pressure feedback-control valve 290 is a combination controllable pressure valve having two states controllable either by electronic solenoid 602 or manual plunger 604 control. The pressure feedback-control valve 290 further comprises a pressure feedback-control inlet 292 and a pressure feedback-control exhaust 294. The pressure feedback-control valve 290 states are functionally equivalent to the other combination controllable pressure valves heretofore discussed. The pressure feedback valve 280 is implemented with a pressure controllable pressure valve having two valve states. The pressure feedback valve 280 further comprises a pressure feedback valve inlet 282 and a pressure feedback valve exhaust 284. The valve states of the pressure feedback valve 280 are controllable by a pressure sensor and are functionally equivalent to the pressure controllable pressure valves heretofore discussed. The check valve 508 in the pressure feedback path 508 enables pressure flow in only one direction to the master pressure sensor 226.

During normal operating conditions, the feedback-control valve 290 is in an energized state and no pressure from the independent pressure source 4 flows to the pressure feedback inlet 282 of the pressure feedback valve 280. If the pressure feedback-control valve 290 detects the occurrence of an EOC (e.g. the mechanical plunger 604 is operated or the solenoid 602 is de-activated), the pressure feedback-control valve 290 ports pressure from the independent pressure source 4 through to the feedback valve inlet 282. Thereafter, if the pressure sensor of the pressure feedback valve 280 detects vacuum pressure at the output of the vacuum pressure port 6, pressure from the independent pressure source 4 is ported from the pressure feedback exhaust 284 through the check valve 508 to the pressure sensor of the master pressure valve 220 thereby enabling the application of the independent pressure source 4 to the vacuum pressure generator 210 and continuous vacuum pressure generation.

If however, the pressure sensor of the pressure feedback valve 280 does not detect vacuum pressure at the output of the vacuum pressure port 6 during an EOC, pressure from the independent pressure source 4 will not be ported through the pressure feedback exhaust 284 and the check valve 508 to the pressure sensor of the master pressure valve 220. Accordingly, this condition prevents the application of the independent pressure source 4 to the vacuum pressure generator 210, and in turn, does not cause vacuum pressure generation thereby maintaining an idle (i.e. non vacuum generating) state.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A vacuum generation and control device for use with an independent pressure source, the vacuum control device comprising:

a. a master control valve, having a master control pressure inlet coupled to a master control pressure exhaust, the master control valve controllable by a first transducer that enables selection of, a first state that retards pressure exchange between the master control pressure inlet and the master control pressure exhaust and, a second state that enables pressure exchange between the master control pressure inlet and the master control pressure exhaust, the master control pressure inlet coupled to the independent pressure source, b. a master pressure valve, having a master pressure inlet coupled to a master pressure exhaust, the master pressure valve controllable by a first pressure sensor that is coupled to the master control pressure exhaust and that enables selection of, a first state that retards pressure exchange between the master pressure inlet and the master pressure exhaust and, a second state that enables pressure exchange between the master pressure inlet and the master pressure exhaust, the master pressure inlet also coupled to the master control pressure exhaust;

c. a vacuum pressure generator, having a positive pressure inlet coupled to a positive pressure exhaust and a vacuum pressure port, the positive pressure inlet coupled also to the master pressure exhaust of the master pressure valve;

d. a feedback pressure valve, having a feedback pressure inlet coupled to a feedback pressure exhaust, the feedback pressure valve controllable by a second pressure sensor that is coupled to the vacuum pressure port and that enables selection of, a first state that retards pressure exchange between the feedback pressure inlet and the feedback pressure exhaust and, a second state that enables pressure exchange between the feedback pressure inlet and the feedback pressure exhaust;

e. a feedback-control pressure valve, having a feedback-control pressure inlet coupled to a feedback-control pressure exhaust, the feedback-control pressure valve controllable by a second transducer that enables selection of, a first state that retards pressure exchange between the feedback-control pressure inlet and the feedback-control pressure exhaust, and a second state that enables pressure exchange between the feedback-control pressure inlet and the feedback-control pressure exhaust, the feedback-control pressure inlet coupled to the independent pressure source and the feedback-control pressure exhaust coupled to the feedback pressure inlet; and f. a check valve coupled between feedback pressure exhaust and the first pressure sensor, the check valve permitting unidirectional flow of feedback pressure to the first pressure sensor.

2. The vacuum control device in claim 1 wherein the first transducer comprises at least one transducer selected from the group consisting of; an electric solenoid or a mechanical plunger.

3. The vacuum control device in claim 1 wherein the second transducer comprises a transducer selected from the group consisting of; an electric solenoid or a mechanical plunger.

4. The vacuum control device in claim 1 further comprising:

a. a master blow-by valve, further comprising a master blow-by inlet coupled to a master blow-by exhaust, the master blow-by valve controllable by an third transducer that enables selection of, a first state that retards pressure exchange between the master blow-by inlet and the master blow-by exhaust and, a second state that enables pressure exchange between the master blow-by inlet and the master blow-by exhaust, the master blow-by inlet coupled to the independent pressure source;

b. a blow-by pressure valve, further comprising a blow-by pressure inlet coupled to a blow-by pressure exhaust, the blow-by pressure valve controllable by a third pressure sensor that is coupled to the master blow-by exhaust and that enables selection of, a first state that retards pressure exchange between the blow-by pressure inlet and the blow-by pressure exhaust and, a second state that enables pressure exchange between the blow-by pressure inlet and the blow-by pressure exhaust, the blow-by pressure exhaust coupled to the vacuum pressure port; and c. a vacuum cut-off valve, further comprising a vacuum cut-off inlet coupled to a vacuum cut-off exhaust, the vacuum cut-off valve controllable by a fourth pressure sensor that is coupled to the master blow-by exhaust and that enables selection of, a first state that retards pressure exchange between the vacuum cut-off inlet and the vacuum cut-off exhaust and, a second state that enables pressure exchange between the vacuum cut-off inlet and the vacuum cut-off exhaust, the vacuum cut-off inlet coupled to the vacuum pressure port, the vacuum cut-off exhaust coupled to the output vacuum pressure port.

5. The vacuum control device in claim 4 wherein the third transducer comprises a transducer selected from the group consisting of; an electric solenoid or a mechanical plunger.

6. The vacuum control device in claim 4 further comprising a filter coupled between the vacuum pressure port and the blow-by pressure exhaust.

7. The vacuum control device in claim 4 further comprising a regulator coupled between the vacuum pressure port and the blow-by pressure exhaust.

8. A pressure feedback circuit for use with a pressure controllable valve that has, a first state that enables a vacuum generator to generate vacuum pressure from a pressure source, and a second state that retards a vacuum generator from generating vacuum pressure from the pressure source, comprising:

a. a feedback-control pressure valve, coupled to the pressure source and controllable by a transducer to enable a flow of feedback pressure from the pressure source to;

b. a feedback pressure valve, controllable by a pressure sensor that senses vacuum pressure and conditionally enables the flow of the feedback pressure from the feedback-control pressure valve to;

c. a pressure check valve, that enables unidirectional flow of pressure to the pressure controllable valve.

9. The feedback circuit in claim 8 wherein the feedback pressure valve conditionally enables feedback pressure flow when positive pressure is sensed.

10. The feedback circuit in claim 8 wherein the feedback pressure valve conditionally enables feedback pressure flow when negative pressure is sensed.

11. A method of controlling a vacuum pressure generator, comprising the steps of:

a. sensing an output pressure of the vacuum pressure generator using a pressure sensor coupled to and controlling a first pressure controllable valve, the pressure sensor also coupled to the output pressure of the vacuum pressure generator, and conditionally, b. applying feedback pressure to a second pressure controllable valve that is coupled to the vacuum pressure generator to enable an input pressure to the vacuum pressure generator, depending upon the pressure sensed at the output of the vacuum pressure generator.

12. The method of claim 11 wherein the sensed output pressure is selected from the group consisting of; positive pressure, or negative pressure.

13. The method of claim 11 further comprising the step of enabling the application of the pressure feedback to the first pressure controllable valve upon the occurrence of an external condition.

14. The method of claim 13 wherein the external condition is selected from a group of conditions consisting of; a loss of electrical power, or a manually commanded emergency stop condition.

* * * * *